US010021975B1

(12) United States Patent
Womble

(10) Patent No.: US 10,021,975 B1
(45) Date of Patent: Jul. 17, 2018

(54) EXTENDIBLE SUPPORT FOR HANGING ARTICLES

(71) Applicant: Barbara B. Womble, Dallas, TX (US)

(72) Inventor: Barbara B. Womble, Dallas, TX (US)

( * ) Notice: Subject to any disclaimer, the term of this patent is extended or adjusted under 35 U.S.C. 154(b) by 0 days.

(21) Appl. No.: 15/335,923

(22) Filed: Oct. 27, 2016

(51) Int. Cl.

| | |
|---|---|
| ***A47B 61/02*** | (2006.01) |
| ***A47B 96/02*** | (2006.01) |
| ***A47B 61/00*** | (2006.01) |
| *A47F 5/00* | (2006.01) |
| *A47G 25/06* | (2006.01) |

(52) U.S. Cl.
CPC ..... *A47B 61/02* (2013.01); *A47B 61/003* (2013.01); *A47B 96/021* (2013.01); *A47F 2005/0012* (2013.01); *A47G 25/0692* (2013.01)

(58) Field of Classification Search
CPC ..... A47B 61/02; A47B 61/003; A47B 96/021; A47F 2005/0012; A47G 25/02; A47G 25/06; A47G 25/0607; A47G 25/0635; A47G 25/0664; A47G 25/0685; A47G 25/0692; A47G 25/08
USPC ..... 211/100, 162, 123, 94.01, 119.003, 113; 223/85, 88, 92, 1, 20; 248/73, 248/223.41–224.61, 225.11, 297.21
See application file for complete search history.

(56) References Cited

U.S. PATENT DOCUMENTS 144,838 A * 11/1873 DeForest ..... A47G 25/743 211/113
786,119 A * 3/1905 Hawley ..... A47G 25/746 211/123
844,447 A * 2/1907 Gautier ..... A47F 5/0846 211/94.01
861,352 A * 7/1907 Blackmore ..... A47F 5/0846 211/113
869,233 A * 10/1907 Drucker ..... A47G 25/746 211/113
943,137 A * 12/1909 Buckingham ..... A47G 25/746 211/120
965,577 A * 7/1910 Gemmer ..... A47G 25/746 211/123
971,647 A * 10/1910 Vanderveld ..... E06B 9/323 211/105.3
977,573 A * 12/1910 Herkert ..... A47G 25/746 211/85.3
979,949 A * 12/1910 Vanderveld ..... A47F 5/0846 211/94.01
992,105 A * 5/1911 Batts ..... A47G 25/746 211/85.3
1,014,020 A * 1/1912 Miller ..... A47F 5/0846 16/95 R
1,052,961 A * 2/1913 Rangnow ..... A47B 61/02 211/100
1,093,232 A * 4/1914 Wolf ..... A47G 25/746 211/124

(Continued)

FOREIGN PATENT DOCUMENTS

SE WO 0226083 A1 * 4/2002 ..... A47B 55/02

*Primary Examiner* — Joshua J Michener
*Assistant Examiner* — Devin Barnett
(74) *Attorney, Agent, or Firm* — Richard G. Eldredge; Eldredge Law Firm

(57) ABSTRACT

An apparatus for support and display of hanging articles includes: a length of wire shelving, and attachment assembly for securing to an underside of the wire shelving, and an extendable and sloping support arm coupled to the attachment assembly.

1 Claim, 2 Drawing Sheets

(56) References Cited

U.S. PATENT DOCUMENTS 1,095,073 A * 4/1914 Bish ..... A47G 25/746 211/120
1,127,782 A * 2/1915 Kurtzon ..... A47G 25/746 211/123
1,132,190 A * 3/1915 Kohout ..... A47G 25/746 211/85.3
1,162,258 A * 11/1915 Schnur ..... A47B 61/02 312/302
1,220,717 A * 3/1917 Bennett ..... A47G 29/083 211/32
1,415,316 A * 5/1922 Corbin ..... A47B 61/02 211/85.3
1,587,675 A * 6/1926 Patterson ..... A47B 61/02 211/1.3
1,639,021 A * 8/1927 Batts ..... A47B 61/003 211/104
1,663,617 A * 3/1928 Steinmetz ..... B42F 15/066 211/113
1,668,662 A * 5/1928 Trethewey ..... A47B 61/02 211/96
1,674,758 A * 6/1928 Batts ..... A47B 61/02 211/85.3
1,749,871 A * 3/1930 Bliss ..... A47G 25/54 206/278
1,966,283 A * 7/1934 Brody ..... A47B 61/02 211/106
2,020,991 A * 11/1935 Brody ..... A47B 61/003 211/123
2,039,758 A * 5/1936 Wayne ..... A47B 61/02 211/100
2,045,941 A * 6/1936 Brody ..... A47B 61/003 211/123
2,128,596 A * 8/1938 Redin ..... A47B 61/02 16/223
2,217,795 A * 10/1940 Dawson ..... A47B 61/02 211/100
2,268,894 A * 1/1942 Ogren ..... A47B 61/02 211/100
2,487,388 A * 11/1949 Sherwood ..... A47G 25/0685 211/100
2,495,848 A * 1/1950 Kiesel ..... F16B 5/0685 211/89.01
2,557,627 A * 6/1951 Baril ..... A47G 25/18 211/100
2,587,111 A * 2/1952 Cashen, Jr. ..... A47G 25/0685 108/29
2,606,666 A * 8/1952 Gray ..... A47J 47/16 211/113
2,740,531 A * 4/1956 Simpkins ..... A47B 61/02 211/85.3
2,917,185 A * 12/1959 Kovacs ..... A47G 25/746 211/94.01
2,985,311 A * 5/1961 Abel ..... A47G 25/746 211/85.3
3,116,837 A * 1/1964 Kelly ..... A47B 61/02 211/94.01
3,124,253 A * 3/1964 Petrich ..... A47G 25/746 211/94.01
3,160,279 A * 12/1964 Hovey ..... A47B 61/02 211/94.01
3,163,295 A * 12/1964 Standard ..... A47K 10/08 211/119.009
3,240,463 A * 3/1966 Cook ..... A47G 29/083 248/215
3,252,583 A * 5/1966 Walther ..... A47B 81/04 211/119
3,335,872 A * 8/1967 Dodich ..... A47G 25/746 211/85.3
3,389,807 A * 6/1968 Manning ..... H03H 7/01 211/162
3,417,874 A * 12/1968 Bryant ..... A47B 61/02 211/100
3,471,031 A * 10/1969 Coplan ..... D06F 57/00 211/100
3,563,182 A * 2/1971 MacFarlane ..... A47B 61/003 108/138
3,730,355 A * 5/1973 Feldman ..... A47F 5/0876 211/119
3,897,122 A * 7/1975 McEvers ..... A47G 25/746 211/85.3
3,954,182 A * 5/1976 McEvers ..... A47G 25/746 211/105.3
4,029,212 A * 6/1977 Uadiski ..... A47G 25/28 211/113
4,109,794 A * 8/1978 Samuel ..... A47G 25/746 211/100
4,201,304 A * 5/1980 Wicklund ..... A47K 10/04 211/123
4,278,177 A * 7/1981 Fahmi ..... A47G 25/18 211/116
4,308,962 A * 1/1982 Fahmi ..... A47G 25/1457 211/118
4,316,547 A * 2/1982 Varon ..... A47F 7/24 211/105.1
4,427,119 A * 1/1984 Savino ..... A47G 25/746 211/105.3
4,474,299 A * 10/1984 Andrews ..... A47F 7/24 211/123
4,488,651 A * 12/1984 Bishop ..... A47K 3/38 211/105.6
D277,248 S * 1/1985 Benedict ..... D6/324
D277,436 S * 2/1985 Benedict ..... D6/315
4,533,056 A * 8/1985 Krikorian ..... A47F 5/13 211/134
D280,575 S * 9/1985 Benedict ..... D6/315
4,585,127 A * 4/1986 Benedict ..... A47B 61/02 211/34
4,611,721 A * 9/1986 Heckaman ..... A47G 25/746 211/100
4,673,089 A * 6/1987 Chap ..... A47G 23/0208 211/119
4,717,028 A * 1/1988 Gochanour ..... A47G 25/48 211/105.1
4,762,238 A * 8/1988 Blanchard ..... A47G 25/32 211/123
4,771,899 A * 9/1988 Benedict ..... A47G 25/746 211/105.3
4,775,056 A * 10/1988 Inglis ..... A63B 1/005 211/100
4,781,349 A * 11/1988 Remmers ..... A47B 96/061 248/249
4,830,199 A * 5/1989 Wolfe ..... A47F 5/0892 211/113
4,863,043 A * 9/1989 Bowen ..... A47G 25/74 211/113
4,869,378 A * 9/1989 Miller ..... A47F 5/0853 211/62
4,872,568 A * 10/1989 Lehmann ..... A47G 25/1457 211/113
D312,389 S * 11/1990 Remmers ..... D8/381
5,018,627 A * 5/1991 Moore ..... A47G 25/0692 206/291
5,076,446 A * 12/1991 Simmerman ..... A47F 5/0093 104/89
D324,490 S * 3/1992 Ricketts ..... D8/373
5,107,996 A * 4/1992 Whittaker ..... A47G 25/1457 211/113
5,178,287 A * 1/1993 Klein ..... A47G 25/746 211/100
5,337,905 A * 8/1994 Gast ..... A47B 61/00 211/105.3
5,531,416 A * 7/1996 Remmers ..... A47B 61/003 211/105.1
5,586,665 A * 12/1996 Brousseau ..... A47F 7/285 193/12
5,695,080 A * 12/1997 Martin ..... F16B 12/38 211/183

(56) References Cited

U.S. PATENT DOCUMENTS 5,697,508 A * 12/1997 Rifkin ..... A47G 25/0692 206/286
5,758,851 A * 6/1998 Remmers ..... A47B 61/003 211/105.1
5,857,577 A * 1/1999 Thomas ..... A47B 57/26 211/94.01
5,950,845 A * 9/1999 Harris ..... A47G 25/0671 211/100
6,053,465 A * 4/2000 Kluge ..... A47B 61/003 248/201
6,085,917 A * 7/2000 Odom ..... A47F 5/0068 211/119.003
6,223,915 B1 * 5/2001 Waner ..... A47F 7/19 211/124
6,227,387 B1 * 5/2001 Rose ..... A47J 47/16 211/113
6,578,720 B1 * 6/2003 Wang ..... A47F 5/01 211/126.15
7,086,543 B2 * 8/2006 Remmers ..... A47B 57/30 211/113
D551,062 S * 9/2007 Nawrocki ..... D8/367
D580,258 S * 11/2008 Fernandez ..... D8/381
7,516,930 B2 * 4/2009 Chen ..... F16B 7/0433 248/304
7,604,131 B1 * 10/2009 Clark ..... B62H 3/12 211/118
D621,244 S * 8/2010 Kundinger, Jr. ..... D8/381
7,806,280 B1 * 10/2010 Perkins ..... A47G 25/0685 211/100
D627,180 S * 11/2010 McCombs ..... D6/705.6
7,946,549 B2 * 5/2011 Forrest ..... A47B 96/06 248/235
7,950,533 B2 * 5/2011 Adams ..... A47F 5/01 211/113
8,141,722 B2 * 3/2012 Heroux ..... A47G 25/1457 211/113
8,397,961 B2 * 3/2013 Viehe ..... A47B 61/003 211/85.3
8,602,227 B1 * 12/2013 McDonald ..... A47F 5/0853 211/193
8,602,228 B1 * 12/2013 Martinez ..... A47F 5/0093 211/100
8,646,624 B2 * 2/2014 Fernandez ..... A47B 45/00 108/108
9,049,931 B2 * 6/2015 Brinton, Jr. ..... A47B 96/02
2002/0148797 A1 * 10/2002 Feder ..... B65D 85/185 211/124
2002/0153337 A1 * 10/2002 Shuen ..... B60R 7/10 211/123
2002/0166825 A1 * 11/2002 Klein ..... A47B 61/04 211/35
2003/0111435 A1 * 6/2003 Chen ..... A47B 61/003 211/123
2003/0189019 A1 * 10/2003 Campbell ..... A47F 5/0846 211/94.01
2003/0234232 A1 * 12/2003 Hernandez ..... B65G 1/0457 211/162
2004/0045920 A1 * 3/2004 Remmers ..... A47B 96/021 211/153
2004/0124163 A1 * 7/2004 Perkins ..... A47B 21/06 211/94.01
2004/0200791 A1 * 10/2004 Bostick ..... A47G 25/746 211/94.01
2005/0029208 A1 * 2/2005 Paiste ..... A47F 7/00 211/85.6
2005/0082245 A1 * 4/2005 Arjomand ..... D06F 57/12 211/125
2005/0224531 A1 * 10/2005 Bulovic ..... A47G 25/0657 223/85
2005/0230577 A1 * 10/2005 Chen ..... A47B 55/02 248/215
2006/0054762 A1 * 3/2006 Shafeek ..... A47H 5/08 248/304
2006/0220502 A1 * 10/2006 Williams ..... A47B 61/02 312/108
2006/0231516 A1 * 10/2006 Moore ..... A47B 61/003 211/85.3
2006/0261230 A1 * 11/2006 Lee ..... A47B 61/003 248/304
2006/0278594 A1 * 12/2006 Macon ..... A47G 25/0692 211/123
2007/0114348 A1 * 5/2007 Nawrocki ..... A47F 5/0006 248/220.21
2007/0170133 A1 * 7/2007 Bryson ..... A47F 5/0869 211/94.01
2008/0087618 A1 * 4/2008 Laney ..... A47G 25/10 211/113
2010/0038496 A1 * 2/2010 Sjoqvist ..... H02G 3/0443 248/73
2010/0122963 A1 * 5/2010 Costa ..... A47G 25/746 211/94.01
2012/0080394 A1 * 4/2012 Shorty ..... A47G 25/0685 211/123
2013/0087520 A1 * 4/2013 Cutler ..... A47K 10/10 211/85.12
2013/0240576 A1 * 9/2013 King ..... A47G 25/28 223/85
2013/0306823 A1 * 11/2013 Liu ..... A47G 29/083 248/339
2014/0034643 A1 * 2/2014 Canfield ..... B65D 85/00 220/212
2014/0048504 A1 * 2/2014 Hayashida ..... A47B 96/00 211/162
2014/0346129 A1 * 11/2014 Hall ..... A47J 47/16 211/162
2015/0014495 A1 * 1/2015 Bausman ..... A47J 47/16 248/176.2
2015/0053632 A1 * 2/2015 Brinton, Jr. ..... A47B 96/02 211/134
2015/0216327 A1 * 8/2015 Zobel ..... A47F 5/0006 211/124
2015/0233639 A1 * 8/2015 Mustari ..... A47F 5/02 211/101
2015/0265069 A1 * 9/2015 Brinton, Jr. ..... A47F 5/01 211/119.003
2015/0282614 A1 * 10/2015 Wyner ..... A47B 61/003 211/85.3
2015/0305519 A1 * 10/2015 Brahar ..... G09F 7/18 29/428
2016/0143438 A1 * 5/2016 Jablow ..... A47B 96/024 211/186
2016/0213111 A1 * 7/2016 Aiello ..... A45C 9/00
2016/0338519 A1 * 11/2016 Singleton ..... A47G 25/1457

* cited by examiner

EXTENDIBLE SUPPORT FOR HANGING ARTICLES

FIELD OF THE INVENTION

The present invention relates generally to supports for hanging articles, and more specifically to support arms designed for the consumer market which can be mounted on a wire shelf for the support of hanging clothing or other articles.

BACKGROUND OF THE INVENTION

Various supports such as valet rods are known in the art. One issue with such supports is that they are often straight bars that telescope and waste space. One such device is the expandable valet by Elfa International AB. Another disadvantage of straight bars is that all but the front facing garment is hidden from view making garment selection difficult. It would be desirable to provide a telescoping sloping support that can be affixed to a length of wire shelving which is frequently employed in residential settings such as closets, and utility rooms.

SUMMARY OF THE INVENTION

The present invention is directed to a sloping support member for hanging articles that is reversibly attachable to wire shelves and the like. The support member is especially useful for planning wardrobe changes, selecting items that need to be dry cleaned and many other wardrobe related tasks.

Multiple support members can attach along a length of wire shelving to provide additional hanging space.

In one aspect of the present invention, a sloping support member is reversibly extendible so that it project forward relative to hanging garments beneath a length of shelving.

In another aspect of the present invention, a sloping support member is reversibly extendible so that it project forward relative to hanging garments beneath a length of shelving which can be pivoted out of the way when desired.

The description as follows is not intended to limit the scope of the invention to the particular forms set forth, but on the contrary, it is intended to cover such alternatives, modifications, combinations and equivalents as may be included within the spirit and scope of the invention as set forth in the detailed description.

DETAILED DESCRIPTION OF THE INVENTION

Figure 1A:
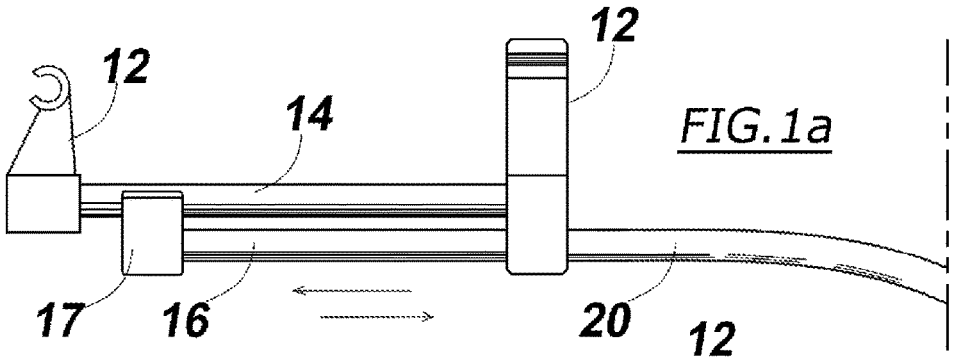
FIG. 1 *a* is first half of a partial plan view of one embodiment according to the present invention.
FIG. 1*b* is the second half of the partial plan view of (FIG. 1*a*)
Figure 3:
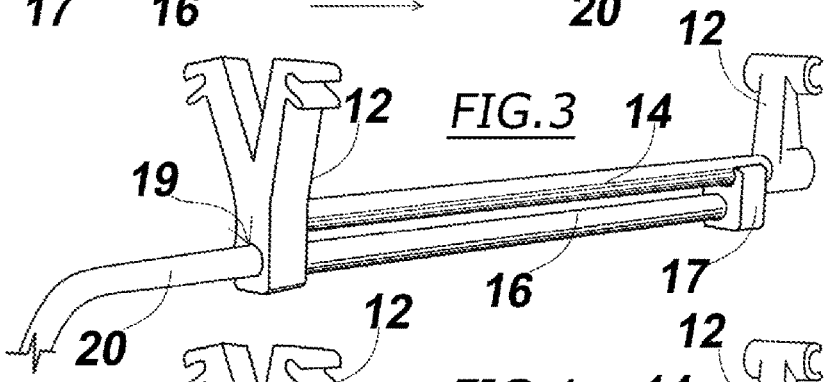
FIG. 3 is a perspective view a portion of the embodiment of (FIGS. 1*a*, 1*b* and 2) that attaches to an underside of a wire shelf.
Figure 4:
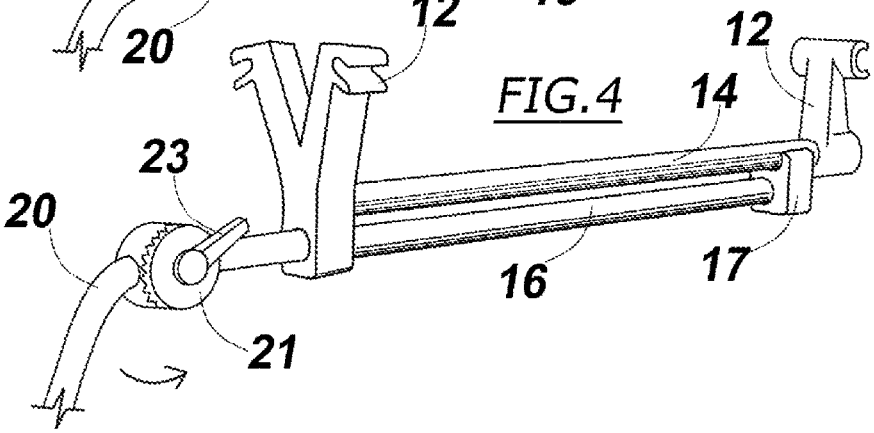
FIG. 4 is a perspective view a portion of another embodiment according to the present invention that attaches to an underside of a wire shelf, that includes a pivoting support arm that can be tightened into a fixed position.
Figure 1B:
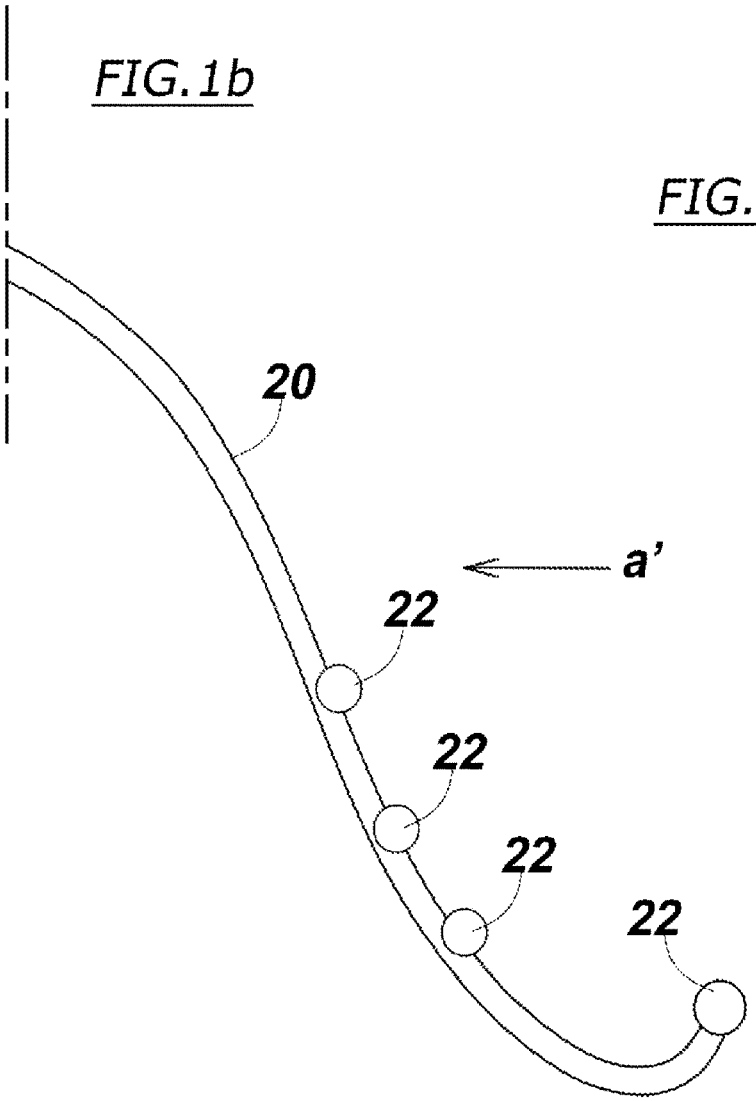
Figure 2:
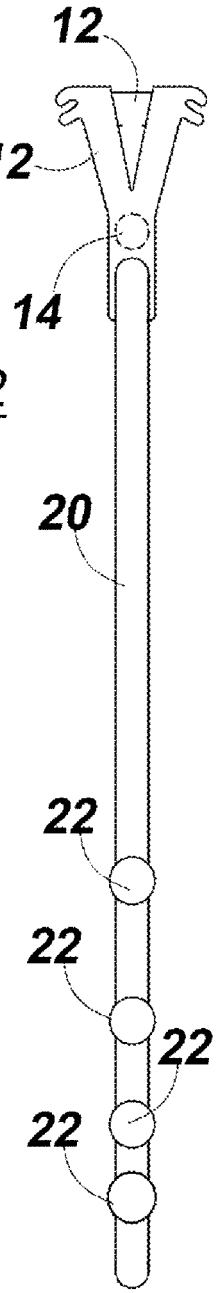
FIG. 2 front facing view of the embodiment of (FIGS. 1*a*, 1*b*) taken in the direction of arrow (a')

Reference listing:

10' sloping support member
12 attachment bracket(s)
14 stationary bar
16 upper end support arm
17 sliding member end cap
20 support arm
21 clamp
22 hanger knobs
23 clamp knob Referring generally to FIGS. 1-4, a support member 10' for displaying garments includes a rigid downwardly sloping support arm 20 with end cap 17 which can be slid in the direction shown by the arrows in FIG. 1*a*, and a shelf attachment assembly including forward and rear attachment brackets 12 that possess recesses for snapping to the transverse and longitudinal wire portions respectively, of wire shelving. Upper end 16 of support arm 20 slides freely within an aperture formed in the forward bracket 12. End cap 17 is shaped and sized to glide along stationary bar 14. The weight of the support arm 20 retains end cap 17 in position wherein it is coupled to stationary bar 14. While stationary bar 14 is presented as a tube or rod, it can be any shape which permits end cap 17 to slide thereon. Both the support arm and the attachment assembly can be made of plastic, metal, a combination of the two materials, or of any suitably rigid material combination suggesting itself to those skilled in the art. While hanger knobs_22 are depicted as a series of spherical members affixed to the support member 20, a series of troughs, waves, or ridges on the support arm can also separate and evenly space a number of garment hanger hooks. While preferably, the support arm is serpentine, it can can straight and pivotable to a number of lockable positions by means of a clamp 21 as shown in (FIG. 4). In this way the support member can both extend outwardly and be pivoted out of the way when desired. Support arm is secured in position by loosening knob 23, pivoting the arm to a desired position which will rotate one side of the clamping plates with meshed teeth, and re-tightening knob 23. It should be understood that the particular clamping means with plates and meshing teeth is but one means of securing the arm in position and other clamping means will suggest themselves to those skilled in the art and having benefit of this disclosure. While the attachment brackets are shown as a pair, it is conceivable that they will be formed together and can further incorporate the stationary bar into a single molded section. Furthermore, it is conceivable that more than one type of support arms can be used with the invention if end cap 17 is removable from the support arm, for example, by use of a set screw. The support are can be made to swing rotationally as well as pivot transversely relative to the wire shelving by permitting upper portion 16 to rotate within end cap 17. This can be accomplished by extending the upper portion through the end cap and placing respectively, a cotter pin, or ring clip through or around terminal end of portion It should be understood that while the support arm is depicted as a curving rod, it can possess a rectangular cross-sectional profile, or for that matter any shaped cross-sectional profile such as a ellipse or triangle among others. For example, while it is intended that hooks portions of garment hangers are placed on top of the arm and held in place by hanger knobs 22, it is conceivable that a support arm can have apertures for placement therethrough of hanger hooks.

While the invention has been described by the particular embodiments given, it is not intended that the scope of the invention be limited to the particular forms set forth. Accordingly, the invention is intended to cover such alternatives, modifications, and equivalents as may be included within the spirit and scope of the invention as defined by the appended claims.

What is claimed is:

1. A storage apparatus for hanging clothes and other articles, the storage apparatus comprising:

an attachment assembly for securing the storage apparatus to an underside of a wire shelving so that the storage apparatus is suspended from the wire shelving, the attachment assembly having:

a forward bracket having a first recess configured to snap on to and grip a transverse wire portion of the wire shelving;

a rearward bracket having a second recess configured to snap on to and grip a longitudinal wire portion of the wire shelving; wherein the transverse wire portion is perpendicular to the longitudinal wire portion; and a bar extending between and attached to the forward bracket and the rearward bracket;

a support assembly coupled to the attachment assembly; the support assembly having:

an extendable arm with an end cap; and a plurality of generally circular hanger knobs secured to the extendable arm;

wherein the plurality of hanger knobs are configured to provide a structure to which the hanging articles can be secured;

wherein the forward bracket is attached to the extendable arm; and wherein the bar is positioned above a portion of the extendable arm via the forward bracket and the end cap which grips a lower surface of the bar.

* * * * *